United States Patent [19]

Hamrin

[11] Patent Number: 4,968,871

[45] Date of Patent: Nov. 6, 1990

[54] INFRA-RED RADIANT HEATER WITH REFLECTOR AND VENTILATED FRAMEWORK

[75] Inventor: Karl-Arvid Hamrin, Kungsör, Sweden

[73] Assignee: Infrarodteknik, AB, Sweden

[21] Appl. No.: 399,534

[22] PCT Filed: Feb. 16, 1988

[86] PCT No.: PCT/SE88/00060

§ 371 Date: Aug. 16, 1989

§ 102(e) Date: Aug. 16, 1989

[87] PCT Pub. No.: WO88/06254

PCT Pub. Date: Aug. 25, 1988

[30] Foreign Application Priority Data

Feb. 17, 1987 [SE] Sweden ..... 8700653

[51] Int. Cl.[5] ..... H05B 3/02

[52] U.S. Cl. ..... 219/343; 219/349

[58] Field of Search ..... 219/343, 347, 348, 349; 362/345, 294, 346, 296, 297

[56] References Cited

U.S. PATENT DOCUMENTS

| | | | |
|---|---|---|---|
| 3,419,714 | 12/1968 | Slauer | 362/345 |
| 3,560,729 | 2/1971 | Liberman | 362/294 |
| 3,654,471 | 4/1972 | Nilsson | 219/343 |
| 3,966,308 | 6/1976 | Nilson . | |
| 4,254,454 | 3/1981 | Hardin, Jr. | 362/294 |
| 4,747,027 | 5/1988 | Rieger | 362/346 |
| 4,766,288 | 8/1988 | Berkes et al. | 219/343 |

FOREIGN PATENT DOCUMENTS

| | | | |
|---|---|---|---|
| 2757299 | 7/1979 | Fed. Rep. of Germany | 362/346 |
| 1353495 | 11/1962 | France | 219/343 |
| 128633 | 11/1969 | Norway . | |
| 340257 | 11/1971 | Sweden . | |
| 373428 | 2/1975 | Sweden . | |
| 1234846 | 11/1969 | United Kingdom . | |
| 2136549 | 9/1984 | United Kingdom | 219/343 |

*Primary Examiner*—Philip H. Leung
*Assistant Examiner*—Geoffrey S. Evans
*Attorney, Agent, or Firm*—Davis, Bujold and Streck

[57] ABSTRACT

An infra-red radiator comprises a ventilated body structure (10) having a cross-web (12), a central leg (14), two side legs (16) and two intermediate support legs (18). Stretched between the legs (14, 16) are two reflectors (24) made of a flexible metal foil material and located in front of IR-lamps (26). Located between reflectors and body structure are ventilating hollows or cavities (36, 38) and channels (40, 57), for cooling or ventilation air, are incorporated in the legs. Inlet channels (40) have upper openings (44) which project cooling air flow along with the rearwardly located surface of the reflector (24), and lower openings (46) which project cooling air flow (52) along the reflector surface located between the reflector (24) and lamp (26). Turbulent cooling air (58) flows in the hollows (36, 38) behind the reflector (24) and passes from inlet openings (54), via laterally offset channels (46) in the support legs (18), to the outlet channels (57) and is exhausted, via openings (50), in the form of a jet or pilot flow (68) which, as a result of an ejector effect, accelerates and amplifies the cooling air flow (52).

9 Claims, 3 Drawing Sheets

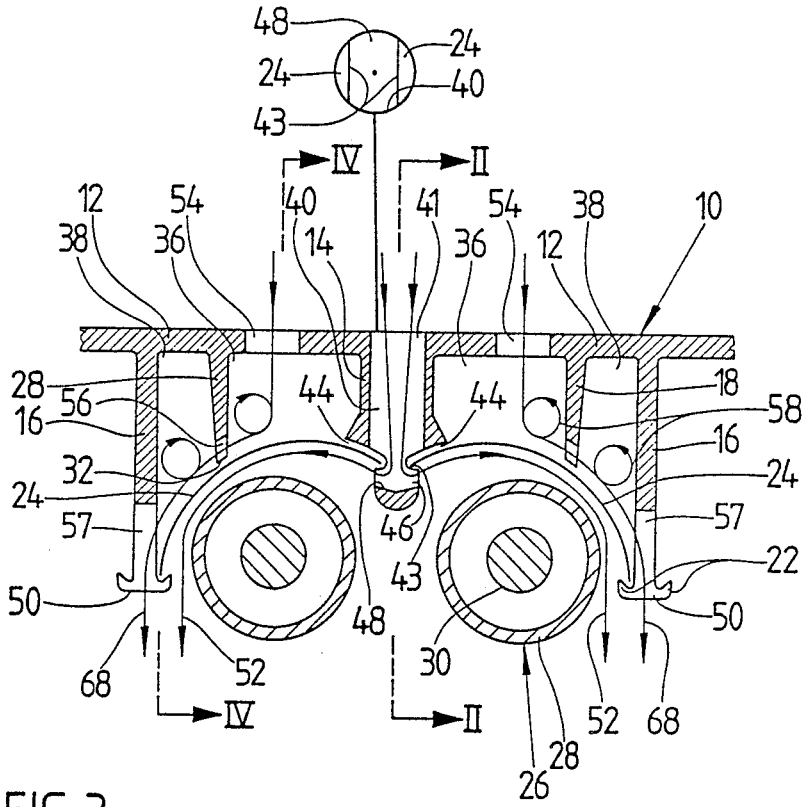
FIG. 3
FIG. 4
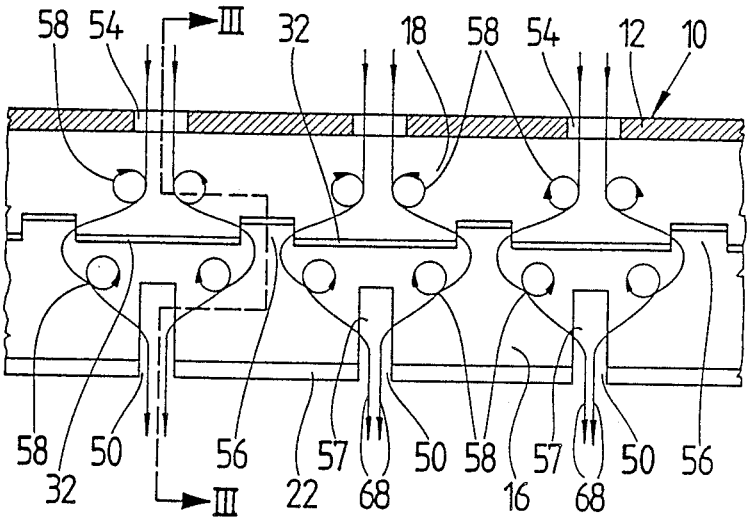

INFRA-RED RADIANT HEATER WITH REFLECTOR AND VENTILATED FRAMEWORK

The present invention relates to an infrared radiating element, hereinafter referred to generally as an IR-radiator.

Prior art IR-radiators of this kind comprise, in the main, a body structure on which there is supported one or more IR-lamps, each with a rearwardly located reflector. Several such IR-radiators my be incorporated in a common body structure. The body structure has hollows or cavities provided therein, for accommodating cooling and ventilating air, i.e. longitudinally extending hollows located beneath respective reflectors and transversally extending hollows and/or terminal communication hollows or channels for the supply and discharge of ventilation air. The hollows or cavities etc. of these known IR-radiators, however, are unsuitably configured and do not therefore provide an effective and uniform cooling effect. This applies paricularly to the region in which reflector and lamp lie in close proximity with one another. This region of the IR-radiator is not readily reached by the cooling air flows and since most of the heat generated is produced in this region of the radiator, the region is an immediate dimensioning factor with regard to the maximum amount of energy that can be taken out from the IR-radiator.

Accordingly, the object of the present invention is to provide an improved IR-radiator in which the ventilating and cooling air flows will act effectively on all parts of the reflector and on the IR-lamp, and which will have a higher maximum power output then known radiators of this kind, and generally constitute a step forward in the art.

To this end there is provided in accordance with the invention an infrared radiator of the aforesaid kind. Thus, because of the particular configuration of the inventive IR-radiator, cooling air will flow advantageously over the surfaces of the reflector.

According to one particularly advantageous embodiment of the invention, the ventilation hollows are configured in a manner to guide the ventilation air flows along the lower or front surfaces and in between reflector and the IR-source, thereby effectively cooling the hottest part of the IR-radiator.

The invention will now be described with reference to non-limiting and exemplifying combinable embodiments of the invention and with reference to the accompanying drawings, in which FIG. 1 illustrates a first embodiment of the invention;

FIG. 3 illustrates a second embodiment of the invention;

FIG. 4 is a sectional view taken on the line IV—IV in FIG. 3;

Figure 1:
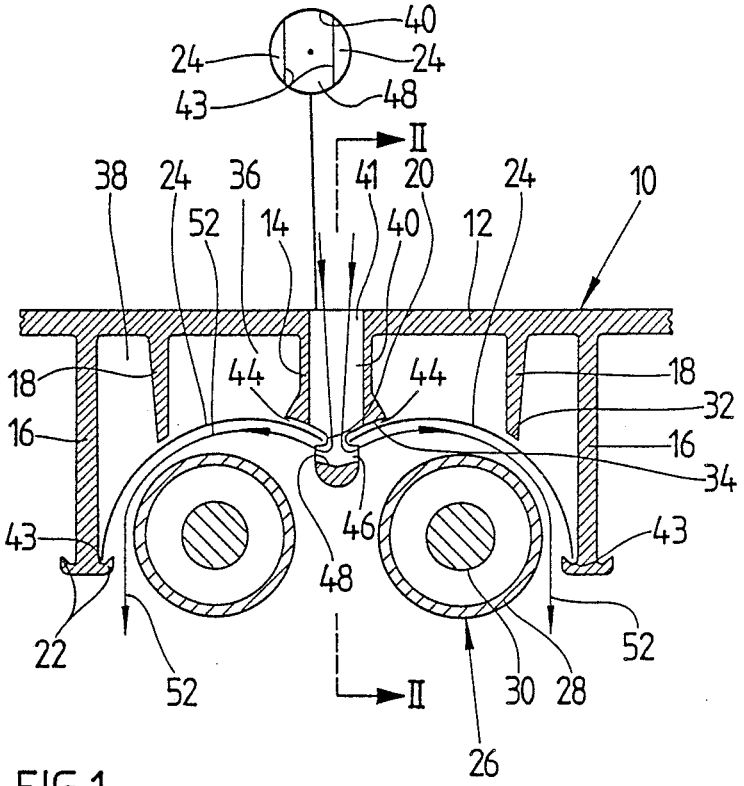
Figure 2:
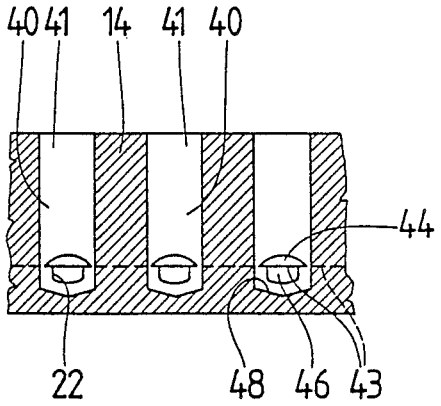
FIG. 2 is a sectional view taken on the line II—II in FIG. 1.

FIGS. 1 and 2 are different sectional views of an infrared radiator of modular construction. Connected to both sides of illustrated IR-radiator are further IR-radiators, which may be of the same or a different kind. The illustrated IR-radiator comprises a body structure 10 having a cross-web 12, a central leg 14, two side legs 16 and two intermediate support legs 18. The central leg and the side legs each incorporate respective slots 20 and projections 22 for the attachment of a reflector 24. The reflector may be of any design kind, but will preferably comprise gold-coated, flexible metal foil. Gold has the best reflective properties and the greatest resistance to corrosion and is therefore used when particularly high radiation powers are desired. Located in front of each reflector is a respective IR-lamp 26 (not shown in detail) which comprises a lamp glass 28 and a helically configured filament 30.

The reflector 24 is caused to abut the side of the side legs 16, the free end surfaces 32 of the support legs 18 and against bearing or abutment surfaces 34 on the central leg 14. This arrangement of the reflector abutment surfaces ensures that the reflector can be brought to and held in a desired position so as to reflect IR-radiation in the manner desired. Furthermore, this abutment of the reflector with said surfaces will result in the formation of two longitudinally extending hollows or cavities 36, 38 which extend between the mutually opposing surfaces of the reflector and the body structure 10 and through which ventilation air is intended to flow for cooling purposes. As will best be seen from FIG. 2, the air is taken from a space behind the cross-web 12 and introduced through inlet apertures 41 into a plurality of channels 40 in the central leg 14, and exits from the channels 40 through outlet apertures located adjacent the longitudinal edge 43 of the reflector 24. Such outlet apertures are divided into upper outlet openings 44, which face towards the rear side of the reflector, and lower outlet openings 46 which face towards the front side of said reflector. The channels 40 are terminated with a respective deflecting surface 48. The lower parts of the central leg incorporating the slot 20, and corresponding projection 22 and the apertured regions of channels 40 thus fulfill two functions, namely the function of forming guiding abutment surfaces for the reflector foil and the function of guiding the air flows along both sides of the reflector.

Air is introduced to the upper surface of the reflector 24 through the upper openings 44, the outer parts of which are configured as grooves in the bearing or abutment surfaces 34. Air will first enter the hollow or cavity 36 and then pass through a slot-like aperture located between the end surface 32 of the support leg 18 and the opposing part of the reflector, into the hollow 38. As air is forced through the slot-like aperture, the air may exert downward pressure on the reflector foil, causing the foil to vibrate. These vibrations will result in enhanced contact of the air with the reflector and therewith in an improved cooling effect. The vibrations may also change the direction in which the radiated rays are emitted, therewith enhancing the effect of the IR-radiator through a change in the direction of scatter. Because the air is forced to pass through a narrow slot, all air will have a cooling effect on the reflector surface adjacent the slot. Furthermore, the throttling effect exerted by the slot-like aperture on the air flows will cause the air to expand on the downstream side of said aperture, therewith, in accordance with Charles' law, causing the temperature of the ventilated air to fall and enhancing the cooling effect of the air on the reflector surface downstream of said slot-like aperture. The reflector region proximate to and downstream of the slot-like aperture in the direction of air flow lies nearest the IR-lamp and an improved cooling effect in this region will enable the power output to be increased.

The air exits from the hollows 38 through an outlet located in the region where the reflector adjoins the free extremity of the side leg 16. For example, this outlet may have the form of a slot defined by the mutually opposing surfaces of the projection 22 and the reflector, or may have the form of small openings (not shown) provided in the reflector 24, or the form of openings 50 provided in the side legs 16 in a manner corresponding to the embodiment illustrated in FIGS. 3 and 4. The exiting air, which is now hot, can be used, for instance, in a drying process.

Cooling air flows 52 exit through the lower outlet openings 46 and flow along and follow the undersurfaces of respective reflectors 24 while passing between reflector and IR-source. In this case, the deflecting surface 48 is contributory in guiding the air flows 52 in an initial direction along the surfaces of the reflector.

The air flows 52 constantly move in close proximity with the reflector surface, up to the point at which the reflector is attached to the side legs 16. These air flows will thus cool the whole of the reflector surface and also that part of the lamp glass 28 which faces towards the reflector, which enables more power to be given out without risk of overheating.

The embodiment illustrated in FIGS. 3 and 4 also comprises a central leg 14 which incorporates channels 40. This embodiment, however, also includes openings 54 which are located in the cross-web 12 adjacent the central leg 14 and which open into the hollows or cavities 36. Air exits from the hollows 36 through channels 56 in the support legs 18 and enters the outwardly located hollows 38 and passes from said hollows through channels 57 to the openings 50 in the side legs 16. The channels 56 are offset axially in relation to respective openings 50 and 54, so as to create turbulence in the air flows 58 in the hollows 36 and 38. This results in the effective transportation of heat away from the upper surfaces of the reflectors. Air in the channels 56 will flow in close proximity with the reflector surface and in the regions there between the reflector lies against the end surfaces 32 of the support legs so that the dissipation of heat can take place from metal to metal, up into the support legs 18. Consequently good heat dissipation is obtained throughout the whole of the critical area.

Ventilation air is also passed in this case over the lower surfaces of the reflectors 24 from the openings 46. Retention of the air flows 52 along the full extent of the reflector surfaces is assisted by the ensuing Coanda effect. In this case, it is possible to include only the bottom openings 46 and to exclude totally the upper openings 44, or to provide only very small upper openings.

Figure 5:
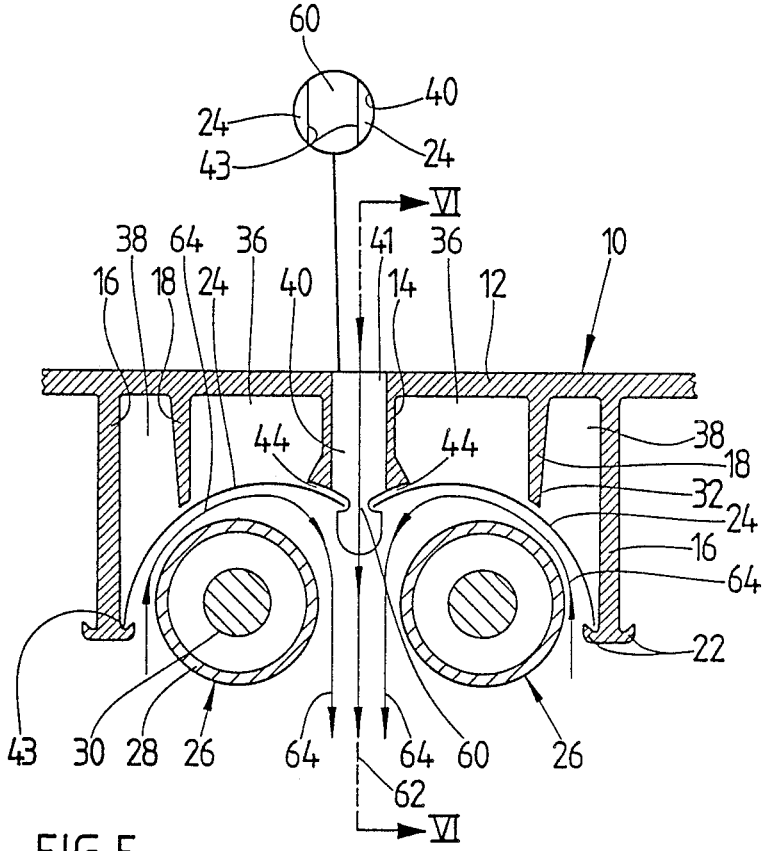
FIG. 5 illustrates a third embodiment of the invention.
Figure 6:
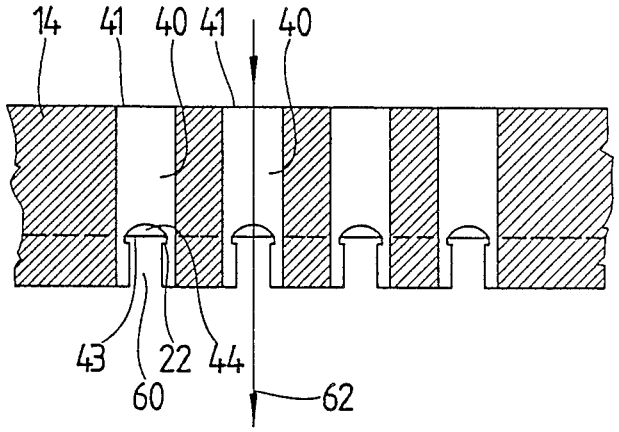
FIG. 6 is a sectional view taken on the line VI—VI in FIG. 5.

FIGS. 5 and 6 illustrate a third embodiment of the invention which differs from the first embodiment in that the third embodiment lacks the deflecting surfaces 48. The third embodiment instead includes downwardly extending, throughpassing bores 60 which are operative in directing jet or pilot flows 62 towards the IR-irradiated area beneath the IR-source. This embodiment also includes openings 44 above the reflector for introducing ventilation air to regions above or behind the reflector.

The third embodiment can be combined with the other embodiments. For example, the channels 40 may be provided alternately with openings according to the embodiment of FIGS. 1 and 2 or the embodiment of FIGS. 5 and 6 respectively. Different combinations with the embodiment of FIGS. 3 and 4 are also conceivable.

In the case of the embodiment illustrated in FIGS. 5 and 6, the jet flows 62 will exert a suction force on the surrounding air and consequently force air to flow along the reflectors 24, as indicated by reference numeral 64. This air flow 64 moves in a direction opposite to the direction of the air flow 52. The air flow 64 also passes between the reflector 24 and the IR-lamp 26.

The ventilation air passing through the hollows or cavities 36, 38, i.e. the turbulent air flows 58 according to FIGS. 3 and 4 and/or the air flows from the upper openings 44 according to FIGS. 1 and 2, and which subsequently pass through the channels 57 and out through the openings 50 also forms the aforesaid jet or pilot air flows 68. These air jets also exert a suction force on the surrounding air and therewith amplify the air flows 52 entering from the aforesaid bottom openings 46 and positively guide the exiting parts of said air flows 52. A preferred IR-radiator according to the invention comprises a unit assembly having two IR-lamps 26 and two reflectors 24 mounted on two side legs 16 and a shorter central leg 14. Two such units may be embodied in one and the same body structure 10, to form a module.

The illustrated and described embodiments are not limitive of the present invention, since modifications can be made by selectively combining different embodiments and seperate features thereof within the scope of the following claims.

The terms "upper" and "lower" as used in the aforegoing to define the conventional location of IR-radiators or IR-sources above a moving path. It will be understood that the invention is not limited to such positions, since the IR-radiator may have any desired location. The aforesaid terms will therefore be understood to relate to the positions of "upper" and "lower" component parts as seen in the drawings and not to constitute a general limitation or definition.

The reflectors of the inventive IR-radiator serve two purposes, firstly to reflect radiation in a known manner and secondly assist actively in guiding cooling-air flows along their surfaces and towards associated IR-lamps. This produces a surprising combination effect and eliminates the need for separate guide elements, such as ventilation-air guide plates and baffles.

I claim:

1. An infrared radiating element comprising a ventilated body structure (10) and at least one flexible metal foil reflector (24) capable of being anchored to the body structure, the at least one reflector having longitudinal edges that are inserted into or hooked onto support means of the body structure for shaping the at least one reflector (24) to the desired configuration, wherein at least a part of a ventilation hollow (36, 38, 40, 57) defined by the body structure (10) is located immediate adjacent at least a major part of a rear surface of the at least one reflector (24) and is configured to guide ventilation air flow (52, 62) along the rear surface of the at least one reflector, and at least a part of the ventilation hollow is configured to impart turbulent conditions (58) to said air flow.

2. An radiating element according to claim 1, wherein the support means are slots (20) and projections (22) arranged in and on legs (14, 16, 18) which project from a cross-web (12) of the body structure (10); and ventilation air channels or hollows (40, 57) are provided in the legs at a location adjacent one of the longitudinal edges

(43) of the at least one reflector and the air channels having openings (44, 46, 50, 60) for engendering positively guided flow of ventilation air.

3. A radiating element according to claim 2, wherein at least one intermediate support leg (18) is provided adjacent the rear surface of the at least one reflector (24), the support leg (18) at least partially abuts against the at least one reflector and divides the space between the at least one reflector (24) and the cross-web (12) of the body structure (10) into two longitudinally extending hollows or cavities (36, 38).

4. A radiating element according to claim 2, wherein the openings (44) from the air channels are provided adjacent at least one of the longitudinal edges (43) and the openings comprise grooves in bearing or abutment surfaces (34) on respective legs and are defined by the rear surface the at least one reflector (24), and extend essentially parallel with the rear surface of the at least one reflector and at right angles to the longitudinal edge (43).

5. A radiating element according to claim 2, wherein lower openings (46) are provided adjacent at least one longitudinal edge (43) of the at least one reflector (24) and extend essentially parallel with front reflector surface and at right angles to the longitudinal edge (43), the lower openings are defined by the front surface of the at least one reflector (24) and a deflecting surface (48) which terminates the ventilation hollows (40).

6. A radiating element according to claim 2, wherein openings (50, 60) are provided adjacent a ventilation hollow (40, 57) in at least one leg (14, 16), said openings being located in an end surface of the legs (14, 16) adjacent the longitudinal edge (43) and are directed essentially in the direction of said leg or at right angles to the cross-web (12), and exiting ventilation air forms a jet or pilot flow (68, 62) which, by an ejector effect, generates or amplifies cooling air flow (52, 64) along a front surface of the at least one reflector (24).

7. A reflecting element according to claim 3, wherein the support leg (18) and the rear surface the at least one reflector (24) form an intermediate slot-like aperture therebetween, the slot-like aperture forms a throttling zone for the ventilation air which flows behind the at least one reflector.

8. A radiating element according to claim 3, wherein the support leg (18) is provided with channels (56) adjacent the at least one reflector (24), the channels allow the passage of ventilation air between the two longitudinally extending hollows (36, 38) of the body structure (10), and the channels (46) are offset in relation to at least one of the openings (44, 50, 54, 57) to engender turbulent air flow (58).

9. A radiating element according to claim 1, wherein two or more IR-lamps (26), each having an associated reflector (24) and an intermediate leg (18), are incorporated in one and the same body structure (10) to form a module.

* * * * *

UNITED STATES PATENT AND TRADEMARK OFFICE

CERTIFICATE OF CORRECTION

PATENT NO. : 4,968,871

DATED : November 6, 1990

INVENTOR(S) : Karl-Arvid HAMRIN

It is certified that error appears in the above-identified patent and that said Letters Patent is hereby corrected as shown below:

Col. 5, line 18 after "surface" insert --of--;

line 22 change "claim 2" to "claim 1".

Col. 6, line 1 change "claim 2" to "claim 1";

line 12 after "surface" insert --of--.

Signed and Sealed this

Seventh Day of April, 1992

*Attest:*

HARRY F. MANBECK, JR.

*Attesting Officer*

*Commissioner of Patents and Trademarks*